US010174488B1

(12) United States Patent
Yeh

(10) Patent No.: US 10,174,488 B1
(45) Date of Patent: Jan. 8, 2019

(54) SINK STOPPER

(71) Applicant: Ta-Yu Yeh, Changhua (TW)

(72) Inventor: Ta-Yu Yeh, Changhua (TW)

( * ) Notice: Subject to any disclaimer, the term of this patent is extended or adjusted under 35 U.S.C. 154(b) by 0 days.

(21) Appl. No.: 15/812,830

(22) Filed: Nov. 14, 2017

(51) Int. Cl.
*A47K 1/14* (2006.01)
*E03C 1/23* (2006.01)

(52) U.S. Cl.
CPC ..... *E03C 1/2306* (2013.01)

(58) Field of Classification Search
CPC ..... E03C 1/2306; E03C 1/23
USPC ..... 4/295
See application file for complete search history.

(56) References Cited

U.S. PATENT DOCUMENTS 4,908,883 A * 3/1990 Rivera ..... A47K 1/14 4/286
5,832,545 A * 11/1998 Pan ..... A47K 1/14 4/293
5,881,397 A * 3/1999 Hobbs ..... A47K 1/14 251/297
6,067,669 A * 5/2000 Peterson ..... E03C 1/262 4/287
6,418,570 B1 * 7/2002 Ball ..... A47K 1/14 4/295
8,499,376 B2 * 8/2013 Kyung Kim ..... E03C 1/2306 4/287
2006/0248637 A1 * 11/2006 Pan ..... A47K 1/14 4/295

* cited by examiner

*Primary Examiner* — Huyen Le
(74) *Attorney, Agent, or Firm* — Che-Yang Chen; Law Offices of Scott Warmuth

(57) ABSTRACT

A sink stopper may comprise an upper cap, a shaft, a pulling handle and a base. The base is configured to be installed in an upper portion of a pipe of a sink drain. Moreover, the base is adapted to cooperate with different sizes of gaskets to fit different sizes of pipes. The shaft has a first connecting section and a second connecting section to fit different sizes of connecting holes of a sink drain. Furthermore, the shaft has a tapered engaging section and a tightening section having the narrower diameter from top to bottom, so that, without external force, a C-shaped ring can firmly clamp on the engaging section or the tightening section, thereby preventing the upper cap from sliding.

7 Claims, 15 Drawing Sheets

SINK STOPPER

FIELD OF THE INVENTION

The present invention relates to a sink stopper and more particularly to a push-pull sink stopper suitable for different sizes of sink drains.

BACKGROUND OF THE INVENTION

A kitchen sink always needs to a sink stopper to collect water in the sink or to enable water to drain. Generally, referring to FIG. 18, a conventional sink stopper has a sink drain (70) and stopper (80). The sink drain (70) has a pipe (71), and a bottom portion of the pipe (71) comprises a supporting portion (72). Moreover, a screw hole (73) penetrates through a central portion of the supporting portion (72). The stopper (80) comprises a lid (81), and an operating head (82) is formed at a top end of the lid (81) while a sealing piece (83) is coupled at a bottom end thereof. Furthermore, a telescopic shaft (84) protrudes from a central bottom portion of the sealing piece (83), and a lower end of the shaft (84) has a threaded section (85) which is configured to engage with the screw hole (73) of the sink drain (70), thereby connecting the stopper (80) with the sink drain (70). When the operating head (82) is pulled or pushed, the up or down motion of the shaft (84) can drive the lid (81) and the sealing piece (83) to stop or allow water to pass through and flow into the pipe (71).

However, the conventional sink stopper is disadvantageous because: (i) the threaded section (85) can only be engaged with the screw hole having a corresponding size, and the leaking is happened when the pipe (71) of the sink drain (70) is different-sized; and (ii) some of conventional sink stoppers even have no supporting portion (72) and screw hole (73), and the shaft (84) of the stopper (80) could not be successfully installed on the sink drain (70). Therefore, there remains a need for a new and improved design for a sink stopper to overcome the problems presented above.

SUMMARY OF THE INVENTION

The present invention provides a sink stopper which comprises an upper cap, a shaft, a pulling handle and a base. The upper cap has an annular plate and a hollow column, and a housing is formed inside the hollow column. A central portion of the annular plate has a connecting opening which is communicated with the housing, and a bottom portion of the housing comprises a compartment and a locating portion which are connected to form in a stepped-shape. A first through hole axially penetrates the hollow column through the connecting opening, and an outer periphery of the hollow column has a flange. Also, a connecting portion formed between the annular plate and the flange is configured to position an annular sealing piece. The shaft has a rod body and a locating head, and an engaging section located between the rod body and the locating head is formed in a tapered shape, and a bottom portion of the rod body comprises a first connecting section having a threaded section on an outer periphery thereof. Moreover, a tightening section is formed between a lower portion of the rod body and the first connecting section, and a diameter of the tightening section is gradually narrow from top to bottom. The shaft is cooperated with a C-shaped ring and a locating sleeve to be installed in the housing. The C-shaped ring clamped on the rod body is coupled in the compartment, and the locating sleeve sleeved on an outer periphery of the shaft is borne against an upper end of the locating portion. The pulling handle has a first threaded section formed at a lower portion thereof, and the first threaded section is configured to engage with the connecting opening of the upper cap to downwardly bear against and limit a position of the locating sleeve. Furthermore, a room is formed inside the pulling handle. The base comprises a screw hole located at a central portion thereof, and a plurality of second through holes axially penetrating through the base are located around the screw hole, and each of the second through holes is spaced with the same distance from the screw hole. Additionally, an annular groove is located at an outer periphery of the base, and a first gasket is configured to be disposed on the annular groove.

In one embodiment, a tool groove is formed at a top surface of the locating head.

In another embodiment, a second connecting section comprising an outer threaded section protrudes from a bottom portion of the first connecting section of the shaft, and the second connecting section has a diameter smaller than the first connecting section.

In still another embodiment, a sealing ring is positioned between the pulling handle and the connecting opening.

In a further embodiment, the base comprises different thicknesses of gaskets to respectively apply to different sizes of sink drains.

In still a further embodiment, the connecting portion has an outer diameter larger than the hollow column.

In yet a further embodiment, the sealing piece, which is made of soft material, comprises a fan-shaped cross section.

Comparing with conventional sink stopper, the present invention is advantageous because: (i) the base installed in an upper portion of the first pipe of the first sink drain is configured to connect to the shaft, and the base has different sizes of gaskets to fit different sizes of pipes; (ii) the shaft has the first connecting section and the second connecting section to fit different sizes of connecting holes of a sink drain; and (iii) with the tapered engaging section and the tightening section having the narrower diameter from top to bottom, without external force, the C-shaped ring can firmly clamp on the engaging section or the tightening section so as to prevent the upper cap from sliding.

DETAILED DESCRIPTION OF THE INVENTION

The detailed description set forth below is intended as a description of the presently exemplary, device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
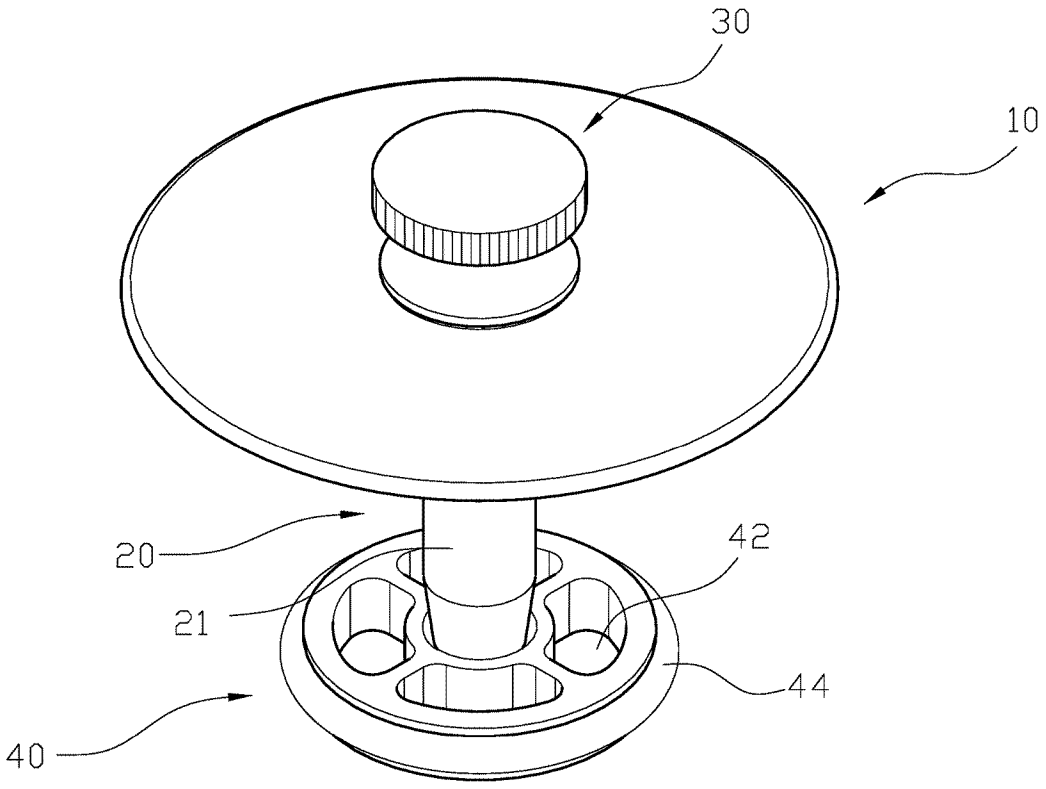
FIG. 1 is a three-dimensional assembly view of a sink stopper of the present invention.
Figure 2:
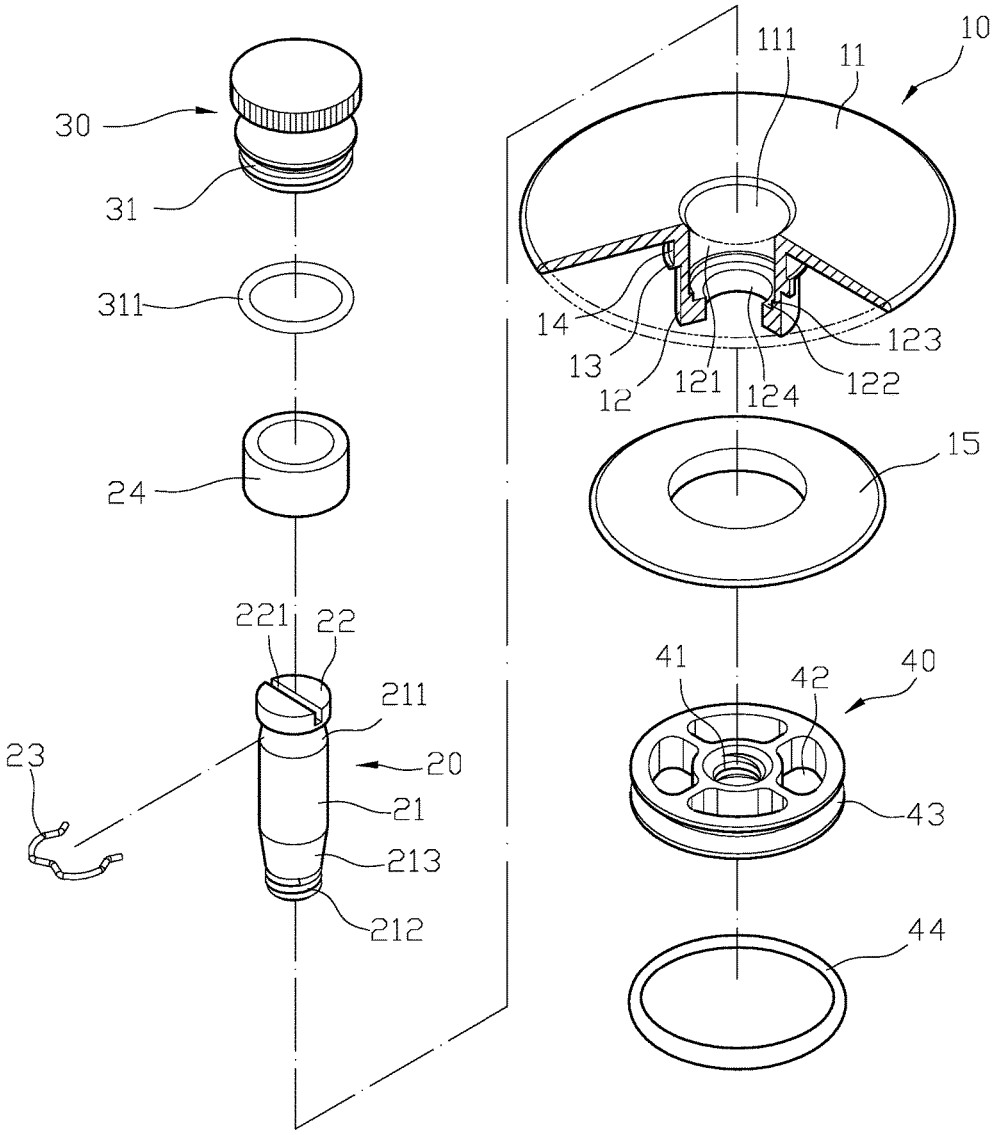
FIG. 2 is an explored view of the sink stopper of the present invention.
Figure 3:
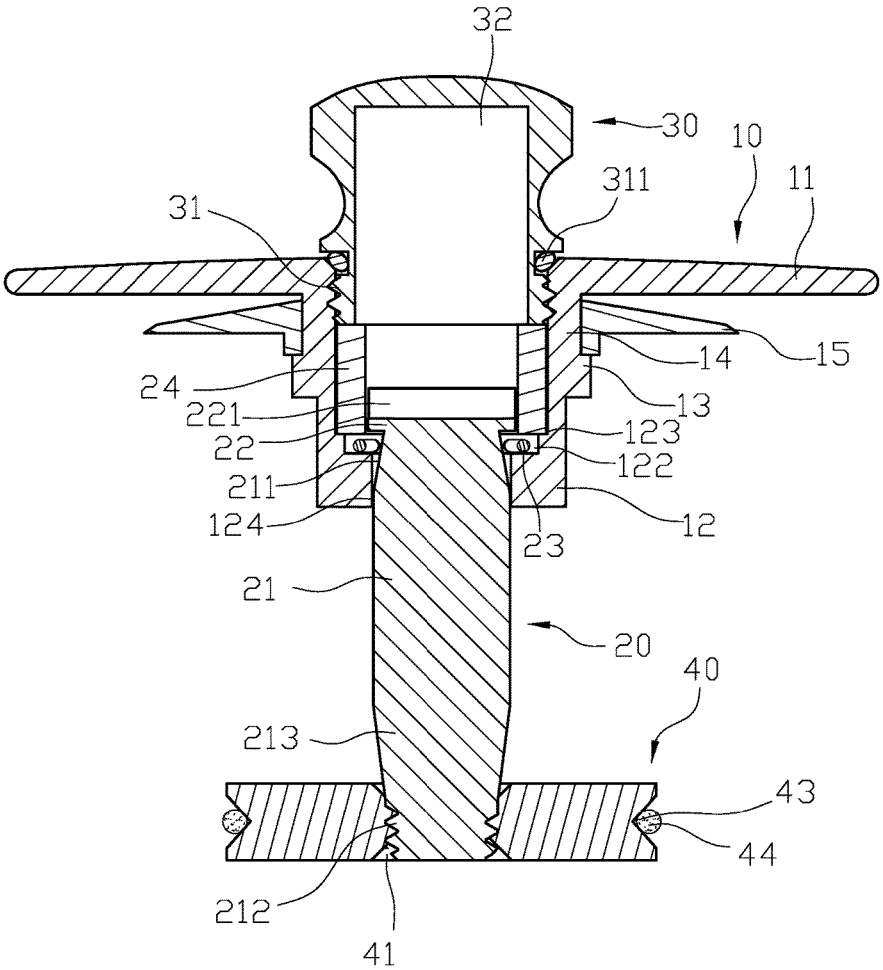
FIG. 3 is a sectional assembly view of the sink stopper of the present invention.

In order to further understand the goal, characteristics and effect of the present invention, a number of embodiments along with the drawings are illustrated as following:

Referring to FIGS. 1, 2 and 3, the present invention provides a sink stopper which comprises an upper cap (10), a shaft (20), a pulling handle (30) and a base (40). The upper cap (10) has an annular plate (11) and a hollow column (12), and a housing (121) is formed inside the hollow column (12). A central portion of the annular plate (11) has a connecting opening (111) which is communicated with the housing (121), and a bottom portion of the housing (121) comprises a compartment (122) and a locating portion (123) which are connected to form in a stepped-shape. A first through hole (124) axially penetrates the hollow column (12) through the connecting opening (111), and an outer periphery of the hollow column (12) has a flange (13). Also, a connecting portion (14) formed between the annular plate (11) and the flange (13) is configured to position an annular sealing piece (15). The connecting portion (14) has an outer diameter larger than the hollow column (12), and the sealing piece (15), which is made of soft material, comprises a fan-shaped cross section. The shaft (20) has a rod body (21) and a locating head (22), and an engaging section (211) located between the rod body (21) and the locating head (22) is formed in a tapered shape, and a bottom portion of the rod body (21) comprises a first connecting section (212) having a threaded section on an outer periphery thereof. Moreover, a tightening section (213) is formed between a lower portion of the rod body (21) and the first connecting section (212), and a diameter of the tightening section (213) is gradually narrow from top to bottom. A tool groove (221) is formed at a top surface of the locating head (22), and the shaft (20) is cooperated with a C-shaped ring (23) and a locating sleeve (24) to be installed in the housing (121). The C-shaped ring (23) clamped on the rod body (21) is coupled in the compartment (122), and the locating sleeve (24) sleeved on an outer periphery of the shaft (20) is borne against an upper end of the locating portion (123). The pulling handle (30) has a first threaded section (31) formed at a lower portion thereof, and the first threaded section (31) is configured to engage with the connecting opening (111) of the upper cap (10) to downwardly bear against and limit a position of the locating sleeve (24). Furthermore, a room (32) is formed inside the pulling handle (30). The base (40) comprises a screw hole (41) located at a central portion thereof, and a plurality of second through holes (42) axially penetrating through the base (40) are located around the screw hole (41), and each of the second through holes (42) is spaced with the same distance from the screw hole (41). Additionally, an annular groove (43) is located at an outer periphery of the base (40), and a first gasket (44) is configured to be disposed on the annular groove (43).

Structurally, referring to FIGS. 1 to 3, the sealing piece (15) is disposed through the hollow column (12) of the upper cap (10) to couple with an outer periphery of the connecting portion (14), and the flange (13) is configured to limit a position of the sealing piece (15). The shaft (20) is configured to be installed in the housing (121) of the hollow column (12), and the rod body (21) of the shaft (20) clamped by the C-shaped ring (23) is positioned in the housing (121). Also, the first connecting section (212) is configured to stick out of the first through hole (124), and an outer diameter of the locating head (22) of the shaft (20) is larger than an inner diameter of the first through hole (124). The C-shaped ring (23) is adapted to limit a position of the shaft (20) in the housing (121), and the locating sleeve (24) positioned in the housing (121) is configured to bear against the locating portion (123) and limit a position of the C-shaped ring (23) in the compartment (122). The inner diameter of the locating sleeve (24) is larger than the shaft (20) such that the shaft (20) is slidable passing through the locating sleeve (24). The first threaded section (31) of the pulling handle (30) is configured to engage with the connecting opening (111) of the upper cap (10), thereby downwardly bearing against and securing a position of the locating sleeve (24) between the pulling handle (30) and the locating portion (123). Moreover, a sealing ring (311) is positioned between the pulling handle (30) and the connecting opening (111). When the shaft (20) is fixed, through pulling or pushing the pulling handle (30), the upper cap (10) is configured to slide relative to the shaft (20). The screw hole (41) of the base (40) is configured to engage with the first connecting section (212) of the shaft (20), thereby completing the assembly of the sink stopper.

Figure 4:
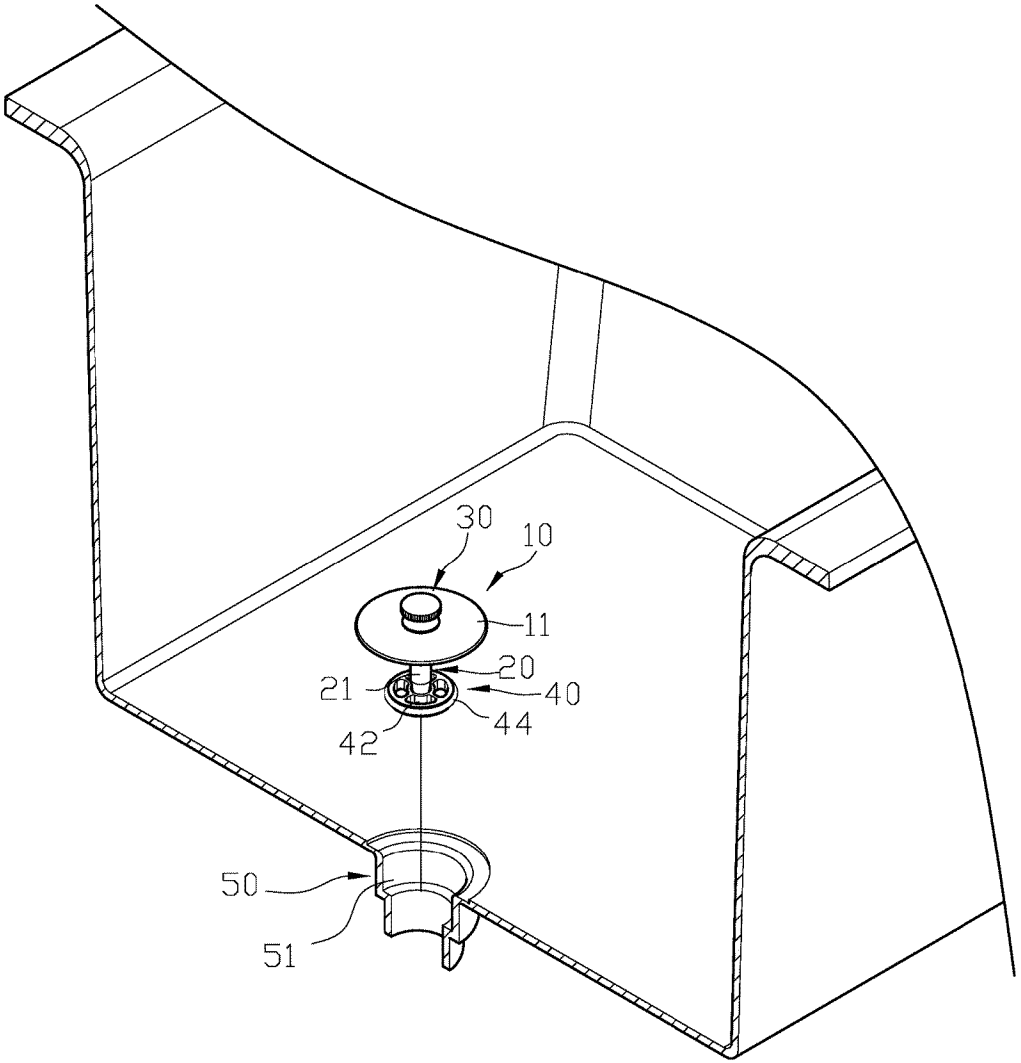
FIG. 4 is a schematic view illustrating the sink stopper of the present invention is installed on a first sink drain.

In actual application, referring to FIG. 4, the sink stopper of the present invention is installed on a sink such as a kitchen sink. When a first sink drain (50) is a straight-through type, the base (40) is cooperated with the first gasket (44) to couple with an inner periphery of a first pipe (51) of the sink drain (50). The first gasket (44) is adapted to bear against the inner periphery of the first pipe (51), thereby securing a position of the base (40) inside the first pipe (51). Furthermore, the screw hole (41) of the base (40) is engaged with the first connecting section (212) of the shaft (20) such that through pulling or pushing the pulling handle (30), the upper cap (10) is moved relative to the shaft (20) upwardly or downwardly, thereby enabling water to flow into the first pipe (51) or blocking the sink drain (50) to collect water in the sink.

Figure 5:
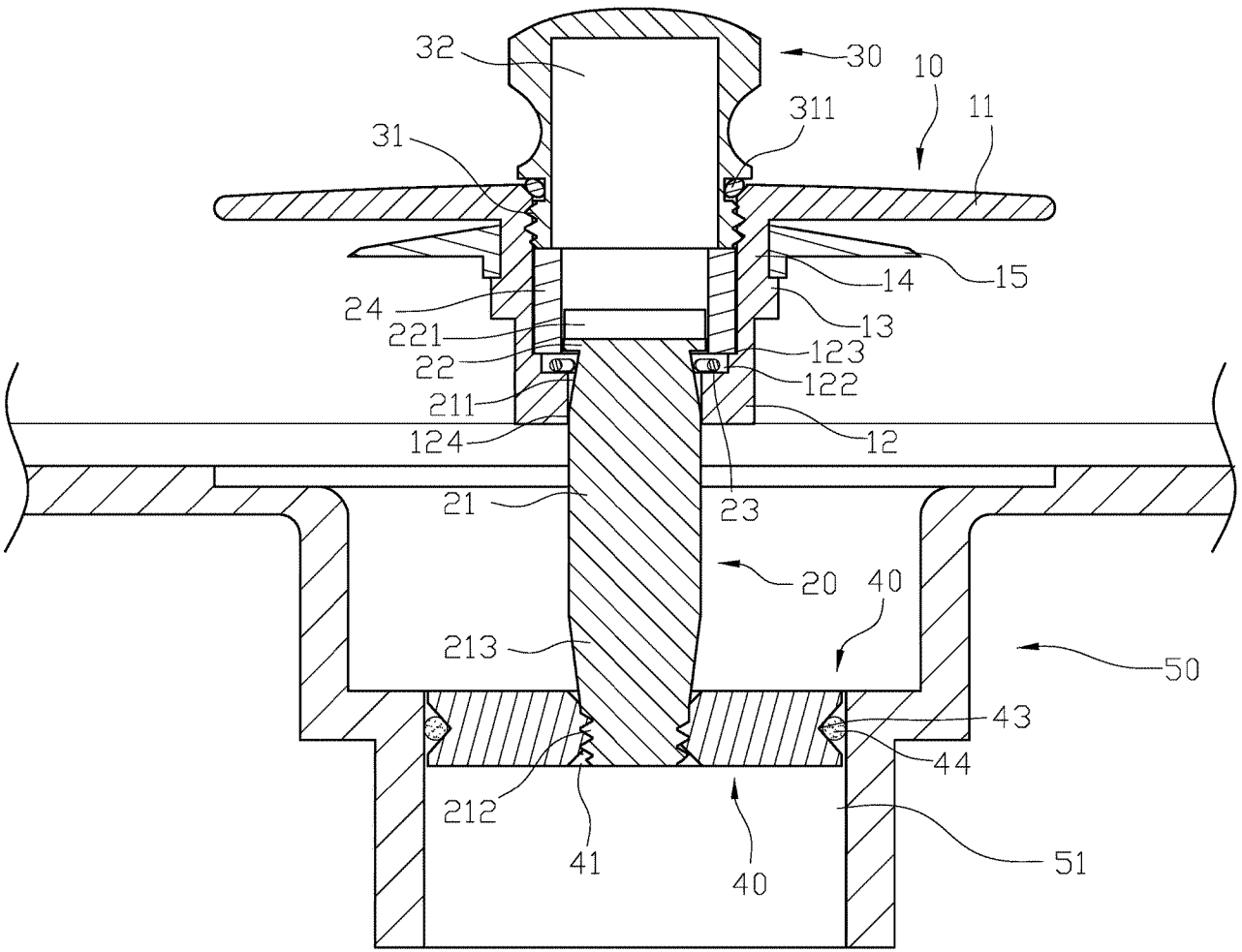
FIG. 5 is a schematic view illustrating the sink stopper of the present invention installed on the first sink drain is at a draining position.

Referring to FIG. 5, when the upper cap (10) is pulled upwardly to allow water to flow into the first pipe (51), the upper cap (10) is located at an upper portion of the shaft (20). Since the C-shaped ring (23) blocked by the locating sleeve (24) is secured in the compartment (122) of the housing (121), when the upper cap (10) is moved upwardly relative to the shaft (20), the C-shaped ring (23) driven upwardly by the upper cap (10) is configured to clamp on an outer periphery of the engaging section (211) of the rod body (21). Thus, without external force, the C-shaped ring (23) is configured to firmly clamp on the engaging section (211) of the rod body (21) so as to prevent the upper cap (10) from sliding downwardly to block water flow.

Figure 6:
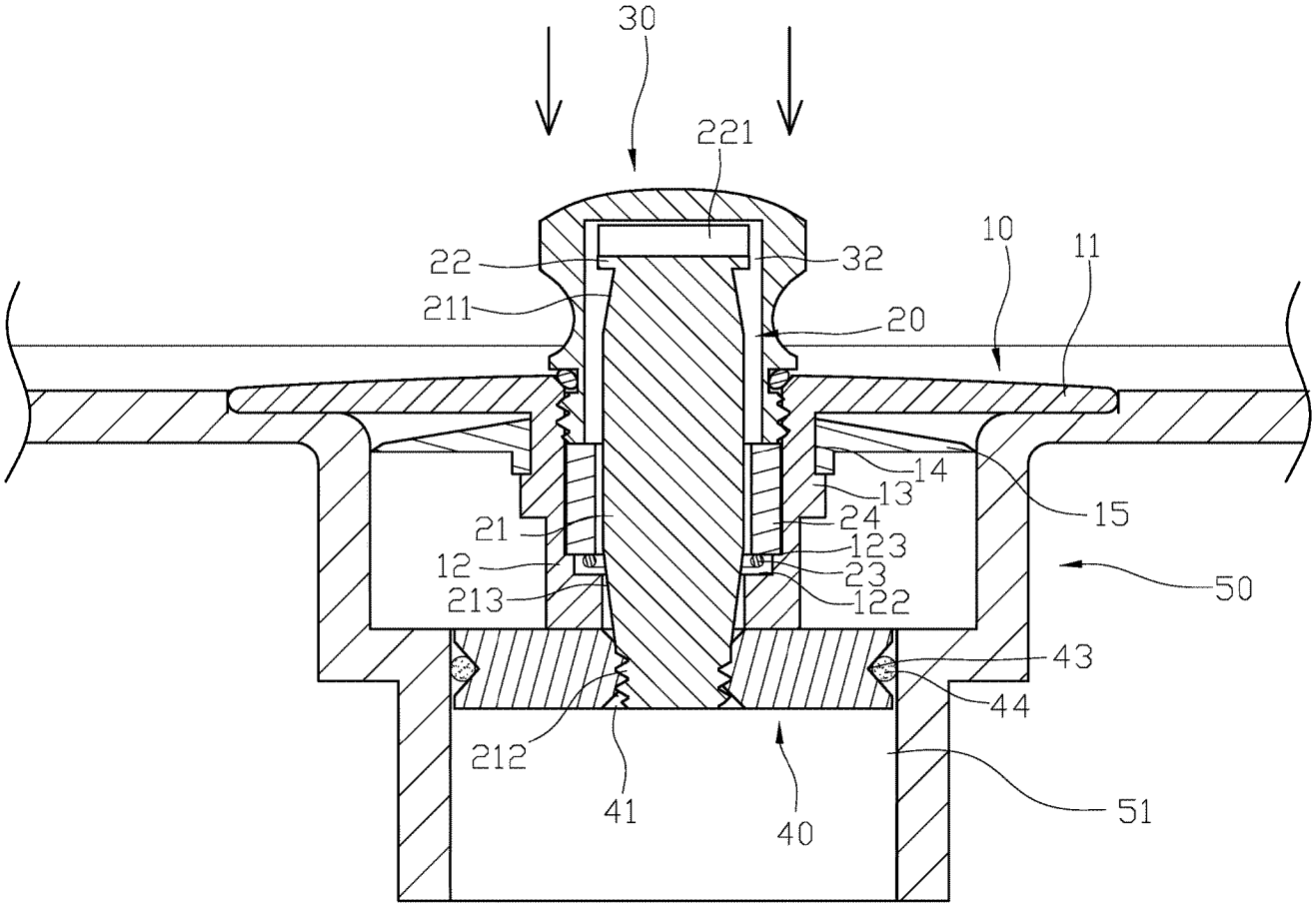
FIG. 6 is a schematic view illustrating the sink stopper of the present invention installed on the first sink drain is at a collecting water position.
Figure 7:
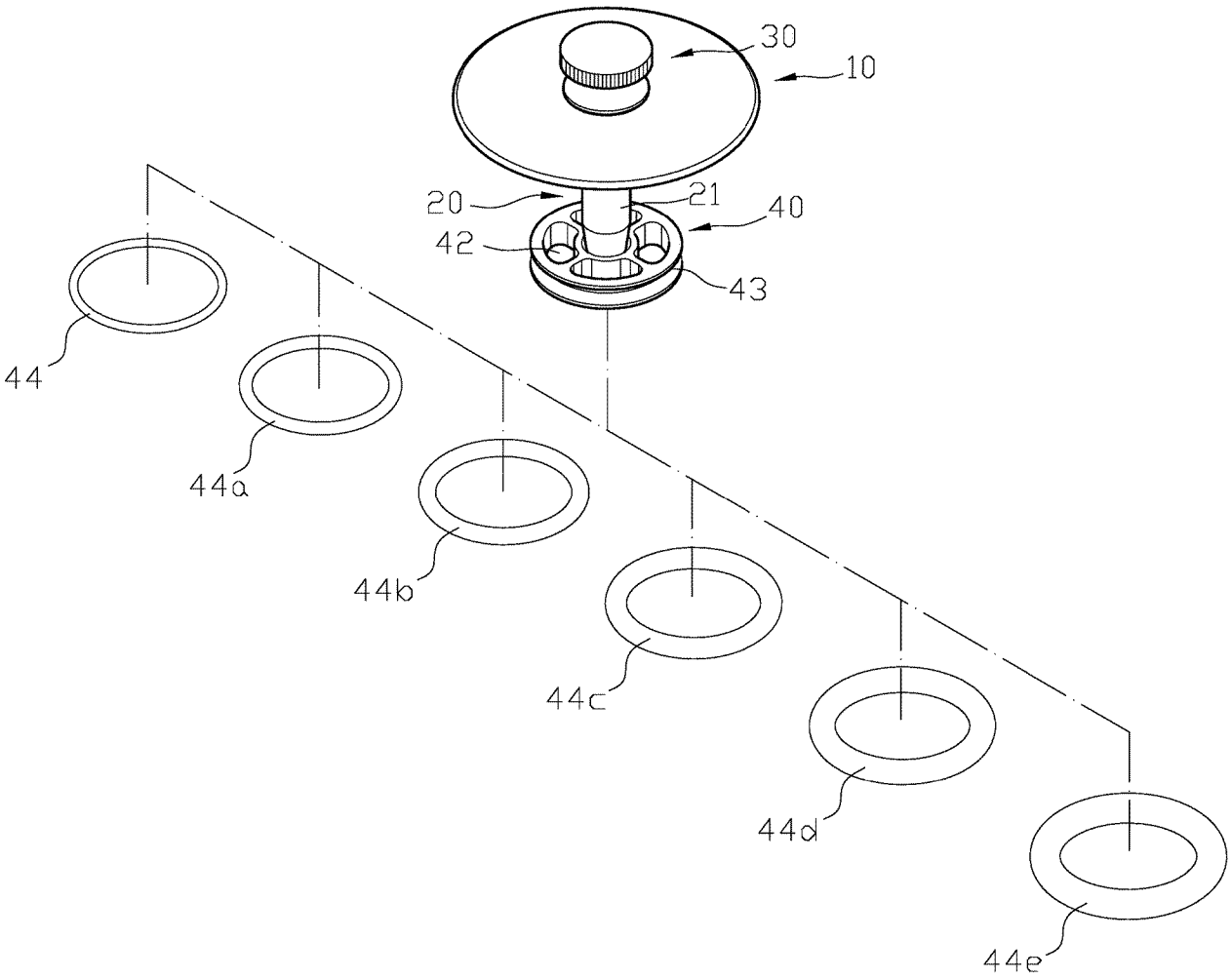
FIG. 7 is a schematic view illustrating a base of the sink stopper of the present invention can cooperate with different sizes of gaskets.
Figure 8:
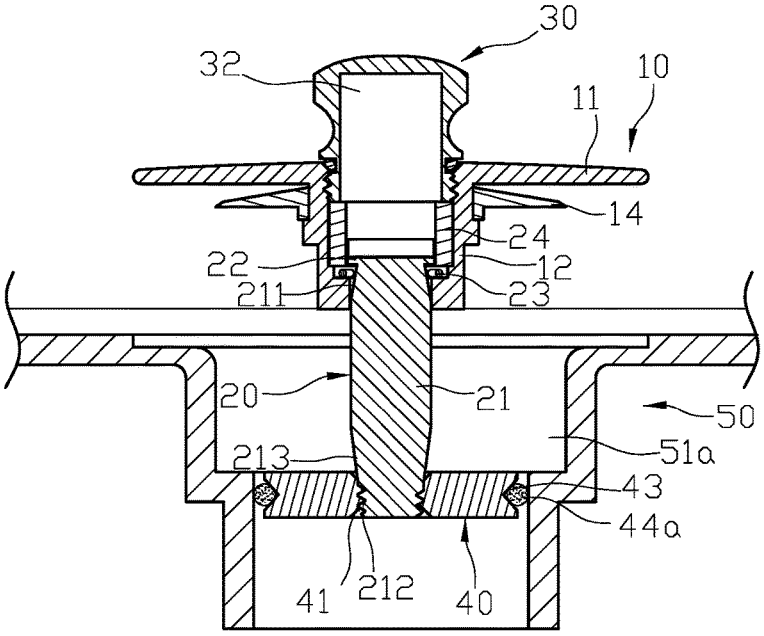
FIG. 8 is a schematic view illustrating a second gasket is disposed on the base to fit a second pipe of the first sink drain.
Figure 9:
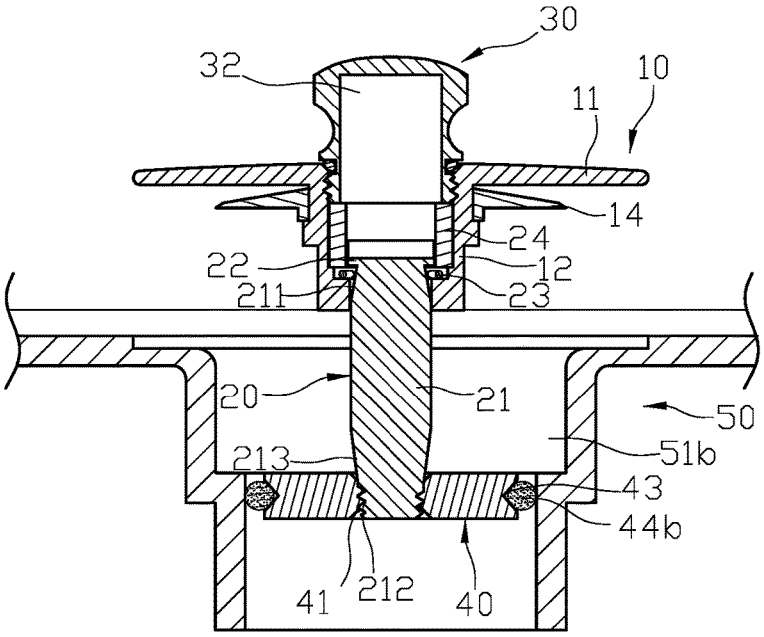
FIG. 9 is a schematic view illustrating a third gasket is disposed on the base to fit a third pipe of the first sink drain.
Figure 10:
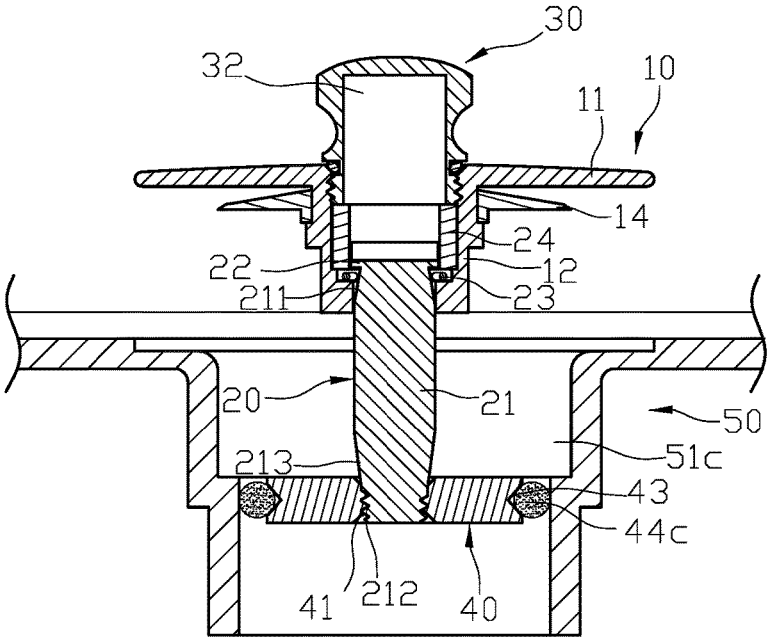
FIG. 10 is a schematic view illustrating a fourth gasket is disposed on the base to fit a fourth pipe of the first sink drain.
Figure 11:
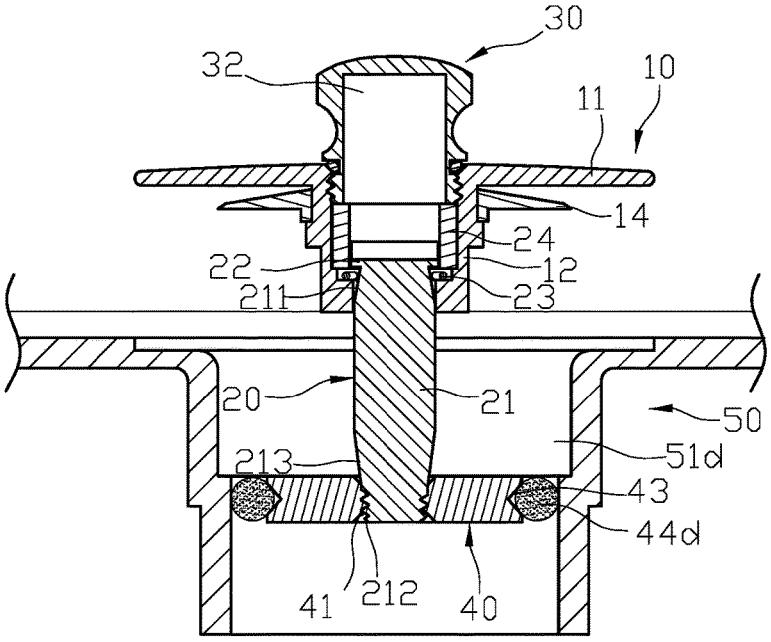
FIG. 11 is a schematic view illustrating a fifth gasket is disposed on the base to fit a fifth pipe of the first sink drain.
Figure 12:
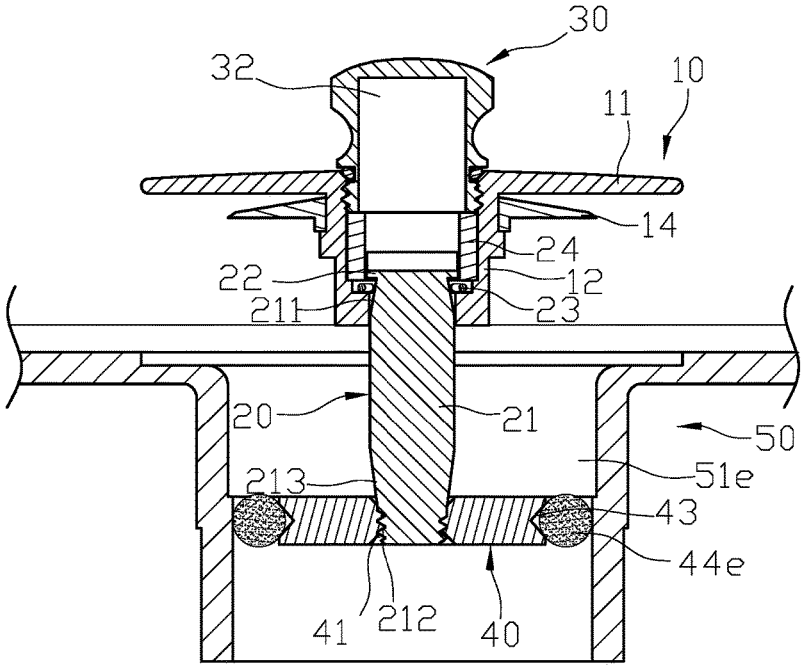
FIG. 12 is a schematic view illustrating a sixth gasket is disposed on the base to fit a sixth pipe of the first sink drain.

On the contrary, referring to FIG. 6, a user can apply force to move the upper cap (10) downwardly relative to the shaft (20) to block the first sink drain (50). When the upper cap (10) is moved, the C-shaped ring (23) is driven to detach from the engaging section (211) toward the tightening section (213) of the rod body (21). Since the diameter of the tightening section (213) is gradually narrow from top to bottom, without external force, the C-shaped ring (23) is configured to clamp on the tightening section (213) so as to prevent the upper cap (10) from sliding and to abut the hollow column (12) of the upper cap (10) against the base (40), thereby securing the position of the upper cap (10). As a result, the upper cap (10) is adapted to block the first pipe (51) of the first sink drain (50), and the sealing piece (15) is tightly borne against the inner periphery of the first pipe (51) to prevent leakage, thereby collecting water in the sink.

Moreover, referring to FIGS. 7 to 12, the base (40) comprises different thicknesses of gaskets including the first gasket (44), a second gasket (44*a*), a third gasket (44*b*), a fourth gasket (44*c*), a fifth gasket (44*d*) and a sixth gasket (44*e*) to respectively apply to different sizes of pipes which are the first pipe (51), a second pipe (51*a*), a third pipe (51*b*), a fourth pipe (51*c*), a fifth pipe (51*d*) and a sixth pipe (51*e*) in order.

Figure 13:
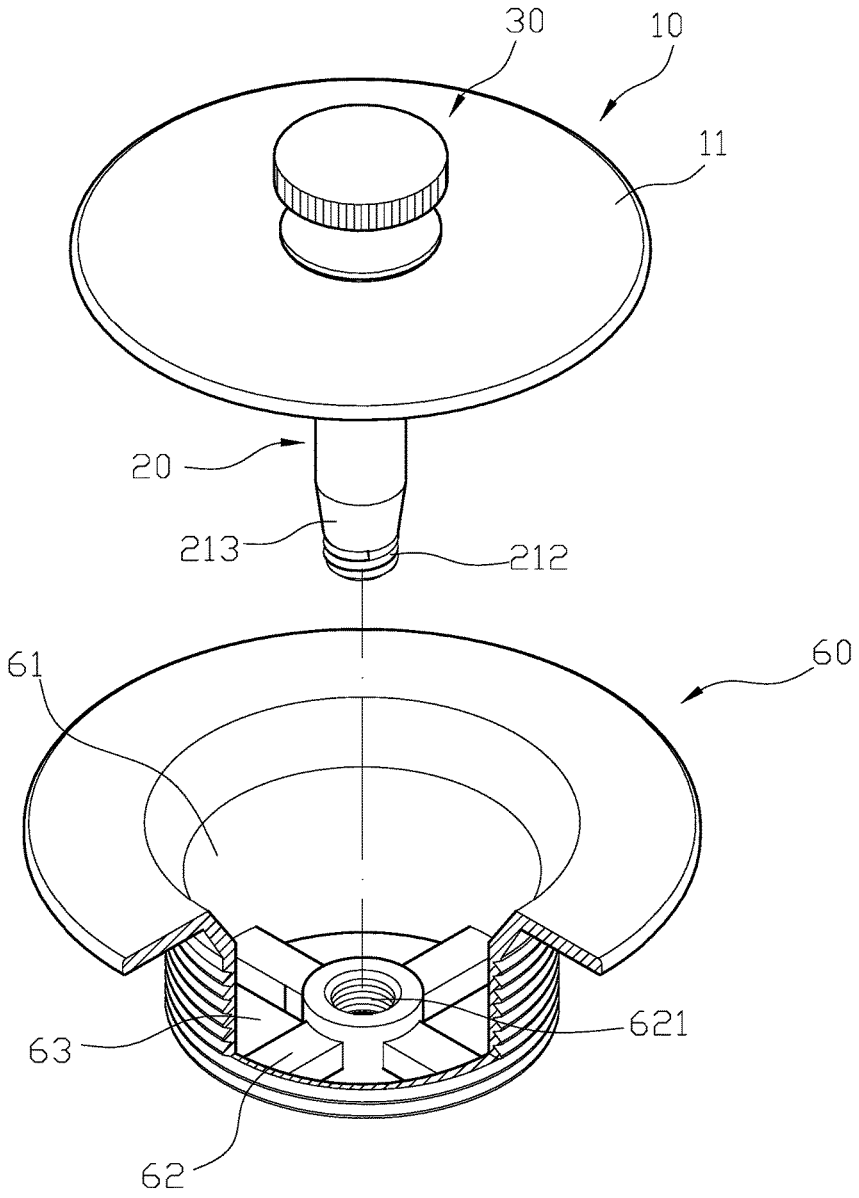
FIG. 13 is an exploded view of a second sink drain of the sink stopper in the present invention.
Figure 14:
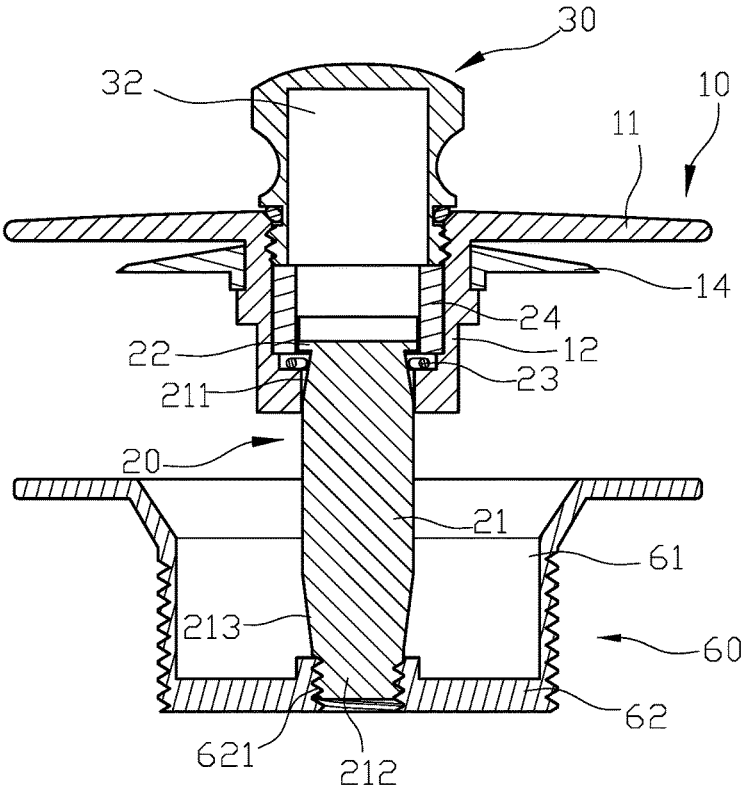
FIG. 14 is a sectional assembly view of the second sink drain of the sink stopper in the present invention.
Figure 15:
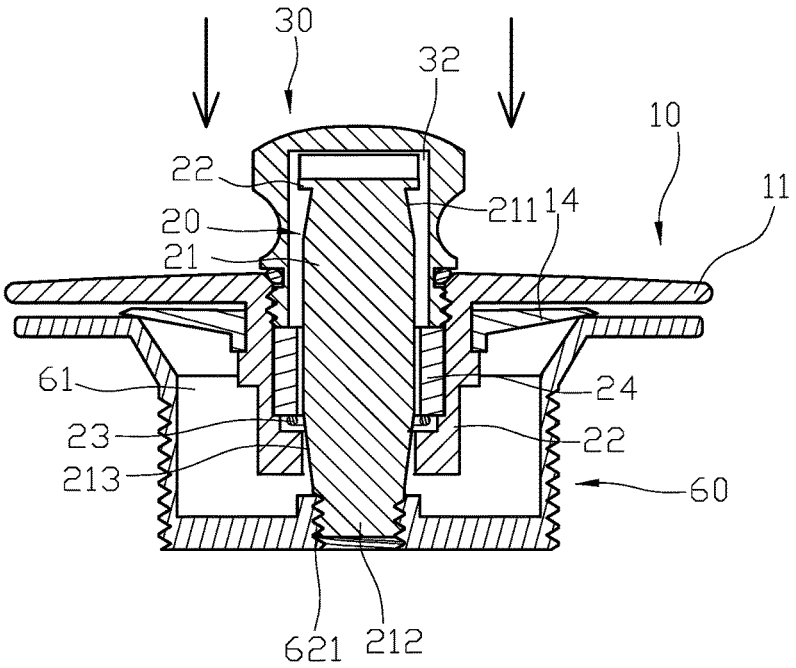
FIG. 15 is a schematic view illustrating the sink stopper of the present invention installed on the second sink drain is at a collecting water position.

Referring to FIGS. 13 to 15, the sink stopper of the present invention can be applied to a second sink drain (60) which comprises a plurality of supporting bars (62) and a seventh pipe (61). The supporting bars (62) are cross at a central junction to form a plurality of drain holes (63) therebetween, and each of the supporting bars (62) is coupled with an inner periphery of an upper portion of the seventh pipe (61) at two ends thereof. A first connecting hole (621) is configured to axially penetrate through the central junction of the supporting bars (62) such that when the base (40) is installed in the seventh pipe (61), the shaft (20) is adapted to be directly engaged with the first connecting hole (621) of the supporting bar (62). A user can pull or push the pulling handle (10) to move the upper cap (10) upwardly or downwardly, thereby achieving the effect of draining water away from sink or collecting water in the sink.

Figure 16:
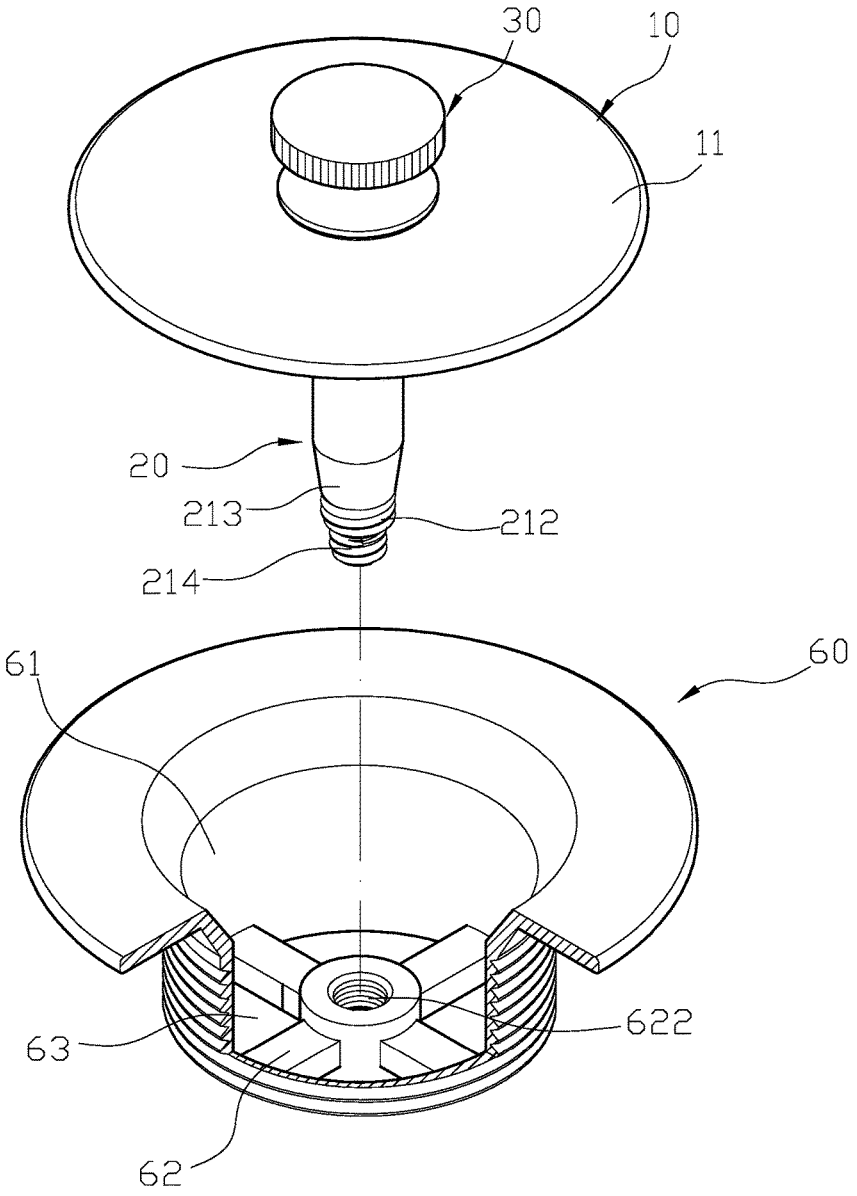
FIG. 16 is an exploded view of another embodiment of the second sink drain of the sink stopper in the present invention.
Figure 17:
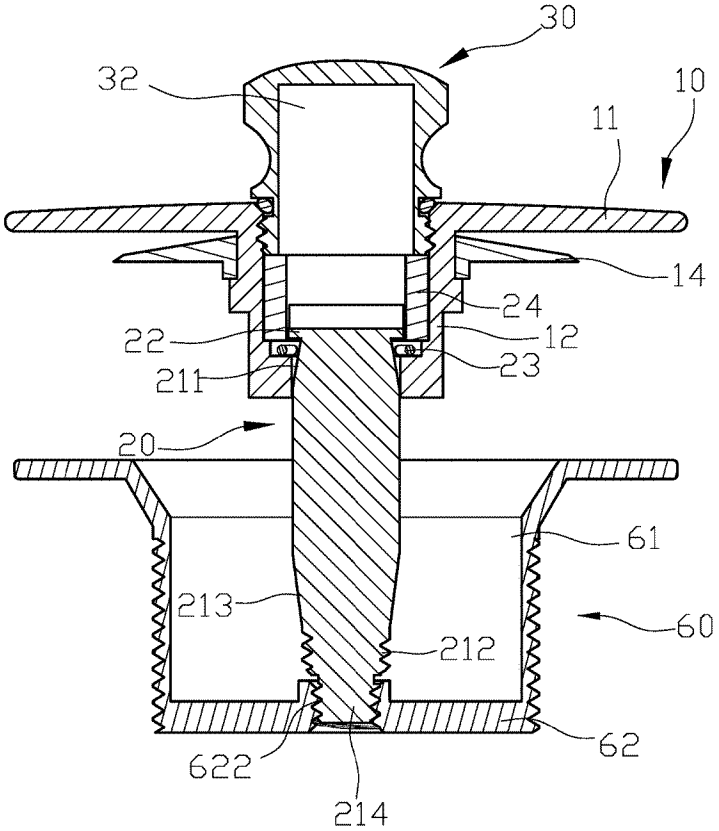
FIG. 17 is a sectional view of another embodiment of the second sink drain of the sink stopper in the present invention.
Figure 18:
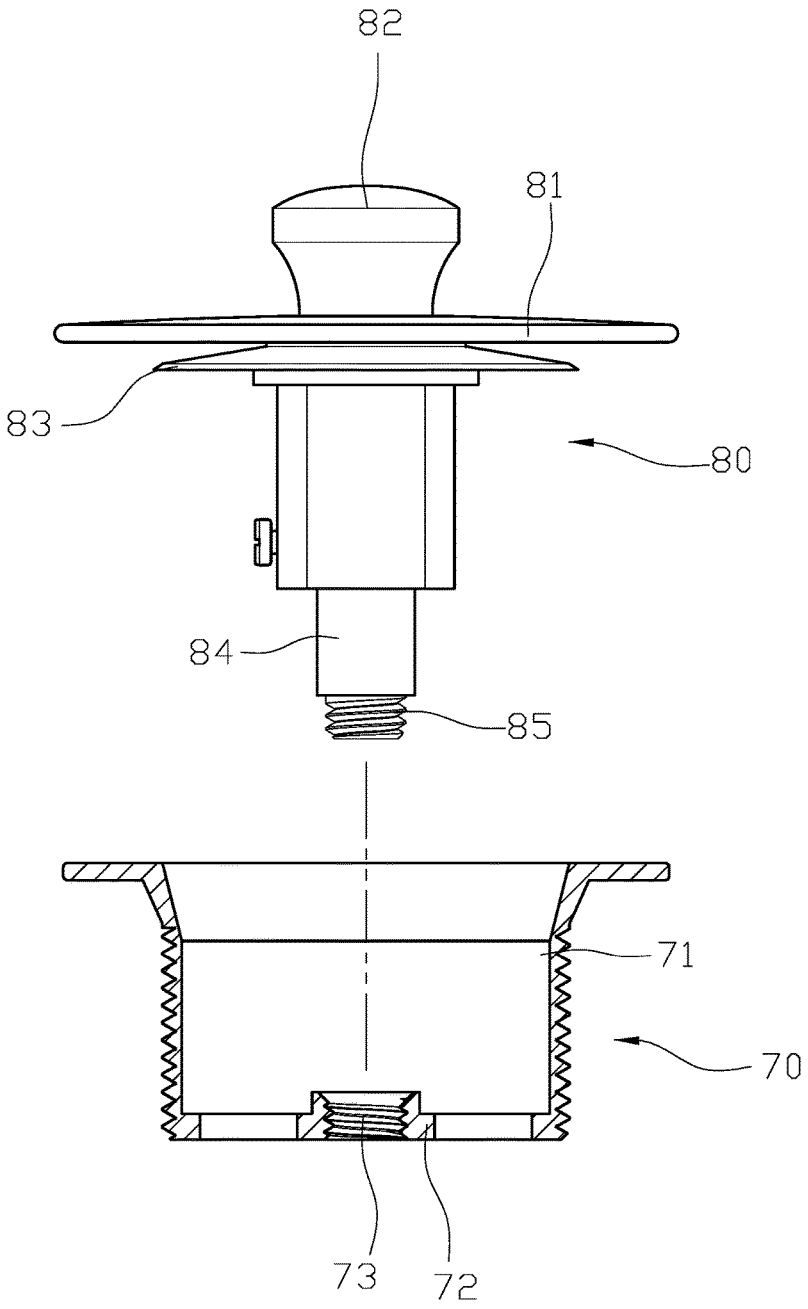
FIG.18 PRIOR ART
FIG. 18 is a prior art.

Referring to FIGS. 16 and 17, a second connecting section (214) comprising an outer threaded section protrudes from a bottom portion of the first connecting section (212) of the shaft (20), and the second connecting section (214) has a diameter smaller than the first connecting section (212) to enable the shaft (20) to connect a second connecting hole (622).

Comparing with conventional sink stopper, the present invention is advantageous because: (i) the base (40) installed in an upper portion of the first pipe (51) of the first sink drain (50) is configured to connect to the shaft (20), and the base (40) has different sizes of gaskets to fit different sizes of pipes; (ii) the shaft (20) has the first connecting section (212) and the second connecting section (214) to fit different sizes of connecting holes of a sink drain; and (iii) with the tapered engaging section (211) and the tightening section (213) having the narrower diameter from top to bottom, without external force, the C-shaped ring (23) can firmly clamp on the engaging section (211) or the tightening section (213) so as to prevent the upper cap (10) from sliding.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A sink stopper comprising:

an upper cap having an annular plate and a hollow column, and a housing formed inside the hollow column; a central portion of the annular plate comprising a connecting opening which is communicated with the housing, and a bottom portion of the housing having a compartment and a locating portion which are connected to form in a stepped-shape; a first through hole axially penetrating the hollow column through the connecting opening, and an outer periphery of the hollow column comprising a flange; a connecting portion, which is formed between the annular plate and the flange, configured to position an annular sealing piece;

a shaft having a rod body and a locating head, and an engaging section, which is located between the rod body and the locating head, formed in a tapered shape, and a bottom portion of the rod body comprising a first connecting section which has a threaded section on an outer periphery thereof; a tightening section formed between a lower portion of the rod body and the first connecting section, and a diameter of the tightening section being gradually narrow from top to bottom; the shaft cooperated with a C-shaped ring and a locating sleeve to be installed in the housing; the C-shaped ring, which is clamped on the rod body, coupled in the compartment, and the locating sleeve, which is sleeved on an outer periphery of the shaft, borne against an upper end of the locating portion;

a pulling handle having a first threaded section which is formed at a lower portion thereof, and the first threaded section configured to engage with the connecting opening of the upper cap to downwardly bear against and limit a position of the locating sleeve; a room formed inside the pulling handle; and a base comprising a screw hole which is located at a central portion thereof, and a plurality of second through holes, which axially penetrate through the base, located around the screw hole, and each of the second through holes spaced with the same distance from the screw hole; an annular groove located at an outer periphery of the base, and a first gasket configured to be disposed on the annular groove.

2. The sink stopper of claim 1, wherein a tool groove is formed at a top surface of the locating head.

3. The sink stopper of claim 1, wherein a second connecting section comprising an outer threaded section protrudes from a bottom portion of the first connecting section of the shaft, and the second connecting section has a diameter smaller than the first connecting section.

4. The sink stopper of claim 1, wherein a sealing ring is positioned between the pulling handle and the connecting opening.

5. The sink stopper of claim 1, wherein the base is configured to cooperate with different thicknesses of gaskets to respectively apply to different sizes of sink drains.

6. The sink stopper of claim 1, wherein the connecting portion has an outer diameter larger than the hollow column.

7. The sink stopper of claim 1, wherein the sealing piece, which is made of soft material, comprises a fan-shaped cross section.

* * * * *